US010398223B2

(12) United States Patent
Felsenthal et al.

(10) Patent No.: US 10,398,223 B2
(45) Date of Patent: Sep. 3, 2019

(54) HANGER AND STORAGE UNIT

(71) Applicant: Whitmor, Inc., Southaven, MS (US)

(72) Inventors: Sandy Felsenthal, Memphis, TN (US); Dan Custer, Southaven, TN (US)

(73) Assignee: Whitmor, Inc., Southaven, MS (US)

( * ) Notice: Subject to any disclaimer, the term of this patent is extended or adjusted under 35 U.S.C. 154(b) by 0 days.

(21) Appl. No.: 15/925,765

(22) Filed: Mar. 20, 2018

(65) Prior Publication Data

US 2018/0344026 A1 Dec. 6, 2018

Related U.S. Application Data

(60) Provisional application No. 62/473,066, filed on Mar. 17, 2017.

(51) Int. Cl.

| | |
|---|---|
| ***A47B 43/00*** | (2006.01) |
| ***A47B 61/00*** | (2006.01) |
| ***A47B 61/04*** | (2006.01) |
| ***A47G 25/00*** | (2006.01) |
| *A47F 7/12* | (2006.01) |
| *A47F 7/19* | (2006.01) |
| *A47F 7/06* | (2006.01) |

(52) U.S. Cl.

CPC ..... *A47B 43/003* (2013.01); *A47B 61/003* (2013.01); *A47B 61/04* (2013.01); *A47G 25/00* (2013.01); *A47F 7/06* (2013.01); *A47F 7/12* (2013.01); *A47F 7/19* (2013.01)

(58) Field of Classification Search

CPC ..... A47B 43/003; A47B 61/003; A47B 61/04; A47F 7/06; A47F 7/12; A47F 7/19; A47G 25/00

USPC ..... 211/118; 312/6

See application file for complete search history.

(56) References Cited

U.S. PATENT DOCUMENTS

| | | | | | |
|---|---|---|---|---|---|
| 1,394,007 | A | * | 10/1921 | Hall | A47B 43/04 312/6 |
| 1,706,873 | A | * | 3/1929 | Date | A47G 25/54 206/287 |
| 1,805,877 | A | * | 5/1931 | Lichtig | A47G 25/58 206/213 |
| 2,016,520 | A | * | 10/1935 | Short | A45C 7/0077 190/107 |
| 2,159,959 | A | * | 5/1939 | Ballentine | A47G 25/54 206/283 |

(Continued)

*Primary Examiner* — Patrick D Hawn

(74) *Attorney, Agent, or Firm* — Stites & Harbison PLLC; Richard S. Myers, Jr.

(57) ABSTRACT

A storage system for holding garments and other items is provided. The storage system can include a storage unit and at least one hanger. The hanger can be inserted into a hanger pocket provided on the sidewall of the storage unit and used to hang the storage system from a hanging rod. The storage unit includes one or more compartments defined by sidewall panels and an overlapping panel connected to and overlapping part of one of the sidewall panels. The sidewall panel and the overlapping panel can form the hanger pocket with a lower opening and an upper opening. The lower opening is sized to allow the hanger to be inserted into the pocket. The upper opening is sized to allow the hook of the hanger to extend from the pocket. When the hanger is inserted into the pocket, the storage system can be hung from a storage rod.

13 Claims, 21 Drawing Sheets

(56) References Cited

U.S. PATENT DOCUMENTS 2,440,192 A * 4/1948 Cowan ..... A47B 61/06 211/149
2,523,682 A * 9/1950 Corwin ..... A47G 25/54 206/285
2,534,380 A * 12/1950 Schwartzman ..... A47G 25/54 206/285
2,561,841 A * 7/1951 Cart ..... A45C 3/004 206/279
2,639,819 A * 5/1953 Marks ..... A47B 43/04 108/149
2,643,003 A * 6/1953 Christie ..... A47G 25/74 206/287
2,645,541 A * 7/1953 Mintz ..... A47G 25/54 206/285
2,845,185 A * 7/1958 Winderweedle, Jr. ..... A47G 25/005 108/149
2,975,529 A * 3/1961 Weber ..... A47K 10/06 206/216
3,184,273 A * 5/1965 Blough ..... A47B 61/04 206/292
4,329,789 A * 5/1982 Erickson ..... F26B 25/18 108/164
4,382,640 A * 5/1983 Kashden ..... A47B 47/06 108/149
D323,941 S * 2/1992 Schwartz ..... D6/317
5,143,214 A * 9/1992 Freelander ..... A47G 25/54 190/13 R
5,713,646 A * 2/1998 Wang ..... A47B 61/06 206/286
6,302,281 B1 * 10/2001 Wang ..... A47B 43/00 190/13 R
6,318,822 B1 * 11/2001 Wang ..... A47B 43/003 108/149
6,390,573 B1 * 5/2002 Wang ..... A47B 61/00 108/149
6,659,273 B1 * 12/2003 Scola ..... A45C 15/00 206/285
6,732,659 B2 * 5/2004 Poon ..... A47B 47/0075 108/42
7,063,397 B2 * 6/2006 Sabounjian ..... A47B 43/003 206/287.1
7,681,728 B2 * 3/2010 Sabounjian ..... A45C 7/0077 206/278.1
D679,121 S * 4/2013 Malone ..... D6/514
8,459,473 B2 * 6/2013 Wang ..... A47B 43/003 211/118
9,089,211 B2 * 7/2015 Wehner ..... A47B 43/00
9,259,082 B2 * 2/2016 Barre ..... A47B 43/003
D817,021 S * 5/2018 Bianco ..... D6/514
2007/0200470 A1 * 8/2007 Wang ..... A47B 43/003 312/6
2009/0206711 A1 * 8/2009 Glenn ..... A47B 43/003 312/108
2015/0083682 A1 * 3/2015 Barre ..... A47B 43/003 211/118

* cited by examiner

HANGER AND STORAGE UNIT

CROSS-REFERENCE TO RELATED APPLICATIONS

This application claims benefit to U.S. Patent Application No. 62/473,066, filed Mar. 17, 2017; the contents of which are incorporated herein by reference.

FIELD OF THE INVENTION

The present invention relates to storage systems, and in particular, storage systems configured for hanging from a hanging rod or rack. The present invention is particularly suited for a closet hanging rod. In these embodiments, the present invention provides increased storage and organization for closets.

BACKGROUND OF THE INVENTION

Hanging closet and storage organizers are well known in the art. These organizers generally consist of a plurality of vertically arranged compartments in the form of boxes or cubes that can be attached to the hanging rod of a closet or suspended from a hanging rack. One common problem with these known organizers is that the components used to hang the compartments from the hanging rod or rack are fixedly secured to the compartments, and thus when the organizer is not in use, it is difficult to compact the organizer for storage. In addition, if one of the hanging components breaks, the organizer can no longer be effectively used.

Further, these commonly known closet and storage organizers are not configured for effectively holding items along the exterior of the organizer, such as ties, scarves, hats, bags and the like.

Accordingly, a need exists for a more efficient storage system that incorporates selectively removable hanging components, that can be easily compacted and stored when not in use, and that can effectively and efficiently hold items along the exterior of the storage system. The present invention helps meet this need.

SUMMARY OF THE INVENTION

The present invention is directed generally to a storage system configured for storing and holding or hanging various items therein or therefrom. The storage system can include at least one hanger and a storage unit. In embodiments of the present invention, the hanger can include a hook member with a lower end, a pair of arms extending in opposing directions from the lower end of the hook member, and a crossbar extending between and below the pair of arms. The storage unit can include at least one storage compartment. The storage compartment can include a pair of opposing sidewall panels, a top panel, a bottom panel and an opening between the sidewall panels to allow access to the interior of the storage compartment. The storage unit can include an overlapping panel provided over part of the sidewall panel of the storage compartment. The overlapping panel can include a perimeter that is at least partially secured to the sidewall panel in order to create a pocket on the exterior of the storage unit. The pocket can include a first lower opening near the bottom portion of the pocket and an upper hook opening near the top portion of the pocket. The lower opening can be configured to allow the hanger to be inserted into the pocket and the arms of the hanger retained within the pocket. The upper hook opening can be configured to allow the hook member of the hanger to exit through the top of the pocket when the hanger is being inserted into the pocket, but prevent the arms of the hanger from exiting the pocket. The storage system can be used by inserting the hanger into the pocket on each side of the storage unit and then placing the hook members of the hangers over a hanging rod or in order to allow the storage unit to remain suspended and hang from the hanging rod or rack. Other aspects and advantages of the present invention will be apparent from the following detailed description of the preferred embodiments and the accompanying drawings figures.

According to one exemplary embodiment of the present invention, the hanger includes one or more accessory hooks formed into the crossbar of the hanger. The accessory hooks can be configured such that when the hanger is inserted into the pocket of the storage unit, the accessory hooks extend outside of the pocket so that a user can hang various items therefrom or thereon.

Other aspects and advantages of the present invention will be apparent from the following detailed description of the preferred embodiments and the accompanying drawings figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
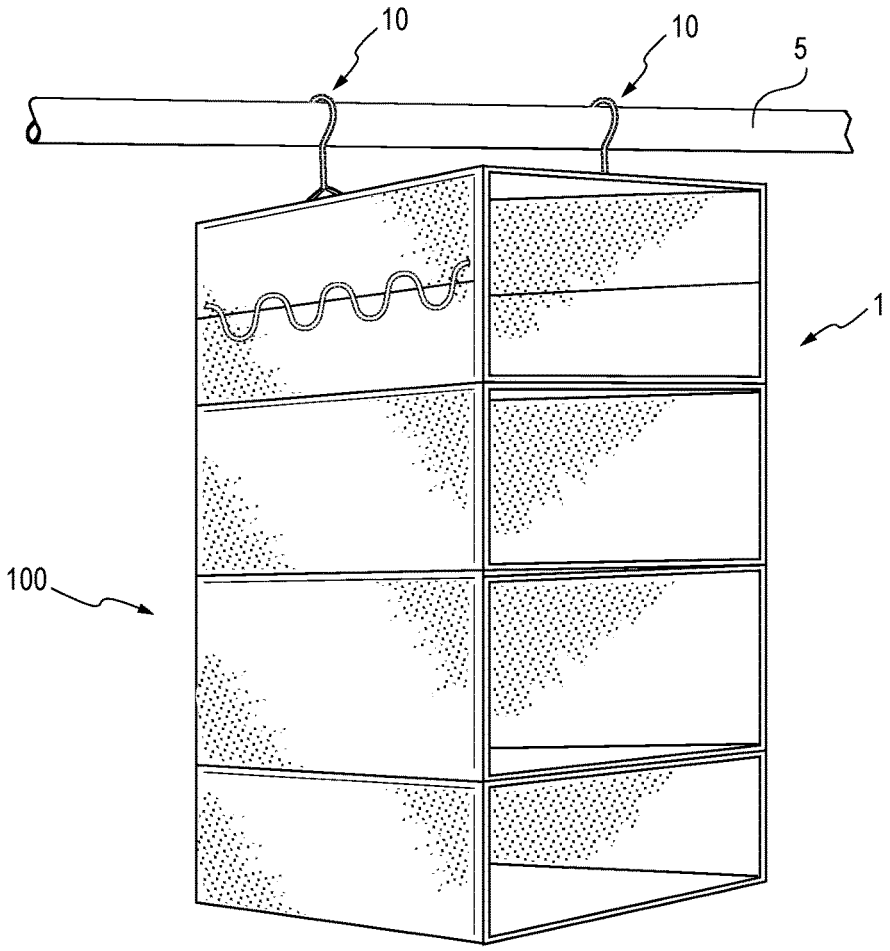
FIG. 1 is a perspective view of a storage system including a hanger and a storage unit in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed to a storage system 1 that can be configured to be suspended or hung from a hanging rod or rack 5. An example of such a hanging rod is the typical hanging rod that appears in a closet. As best shown in FIG. 1, storage system 1 can comprise one or more hangers 10 and a storage unit/shelving unit 100. As shown, hangers 10 can be inserted into storage unit 100 (as described in greater detail herein) and used to suspend storage unit 100 from hanging rod 5. While suspended, storage system 1 can any number of different items or objects in storage unit 100 and on hanger 10 as desired by a user (as illustrated in FIG. 10B).

Figure 2:
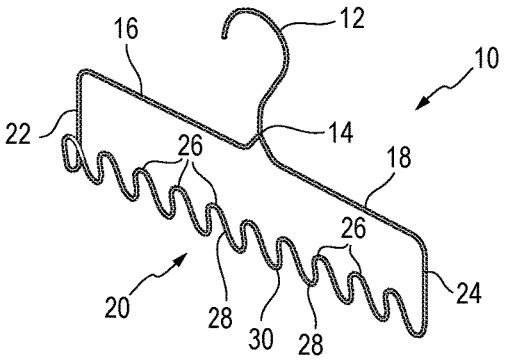
FIG. 2 is a perspective view of a hanger for use in a storage system in accordance with one embodiment of the present invention.
Figure 3:
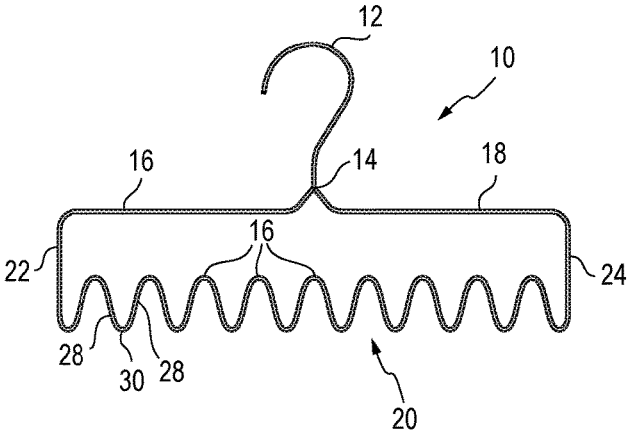
FIG. 3 is a front elevation view of the hanger of FIG. 2.
Figure 4:
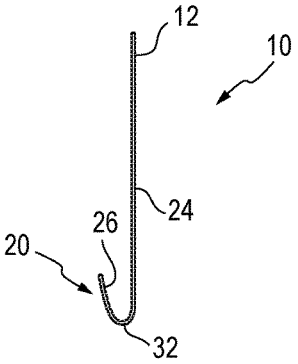
FIG. 4 is a side elevation view of the hanger of FIG. 2.

Turning to FIGS. 2-4, according to one embodiment of the present invention, hanger 10 can comprise a hook member 12 having a lower end 14, first and second arms 16 and 18 extending in opposing directions from one another and a crossbar 20 extending between the arm outer ends 22 and 24, respectively, of first and second arms 16 and 18. As shown, first and second arms 16 and 18 can extend generally horizontally from hook member lower end 14 and outer ends 22 and 24 can bend downwards to create a gap between first and second arms 16 and 18 and crossbar 22. In alternative embodiments (not shown) first and second arms 16 and 18 can extend at a downward angle from hook member lower end 14 to form a triangular shape. In other words, the arms do not have to be parallel to the cross bar. It is also recognized that hanger 10 can have any number of different shapes and configuration suitable for hangers commonly known in the art.

As best shown in FIGS. 2 and 3, according to certain embodiments of the present invention, hanger 10 can include one or more accessory hooks 26 provided on the crossbar 20. Accessory hooks 26 can extend from crossbar 20 and can be used to hold or support various items. For example, when storage system 1 is utilized for garment or closet storage, accessory hooks 26 can be used to hang belts, ties, scarves, bag handles or other similar items. It is also recognized that accessory hooks can be used hang any number of different types of items.

Figure 12:
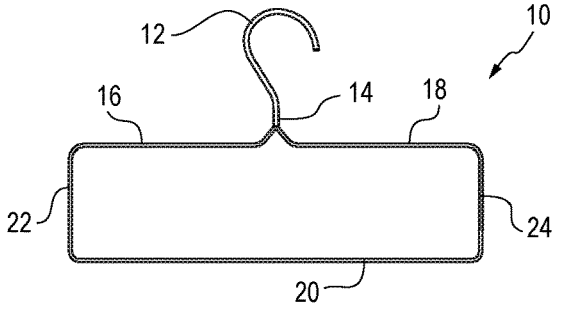
FIG. 12 is a front elevation view of a hanger for use in a storage system in accordance with another embodiment of the present invention.
Figure 13:
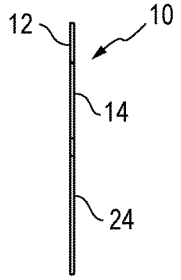
FIG. 13 is a side elevation view of the hanger of FIG. 12.
Figure 14:
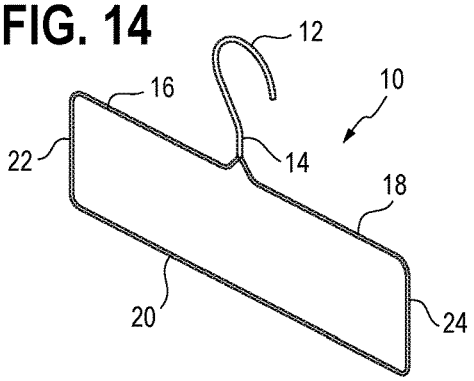
FIG. 14 is a perspective view of the hanger of FIG. 12.
Figure 15:
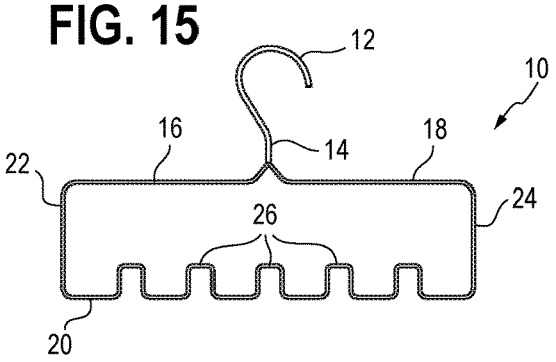
FIG. 15 is a front elevation view of a hanger for use in a storage system in accordance with another embodiment of the present invention.
Figure 16:
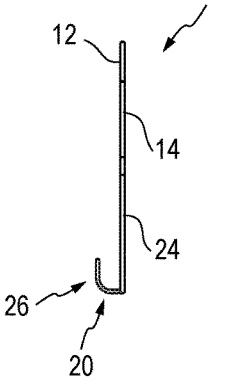
FIG. 16 is a side elevation view of the hanger of FIG. 15.
Figure 17:
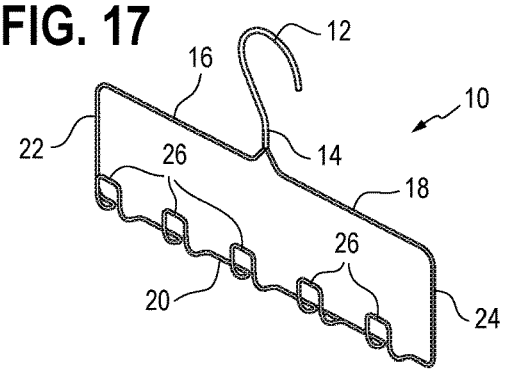
FIG. 17 is a perspective view of the hanger of FIG. 15.
Figure 18:
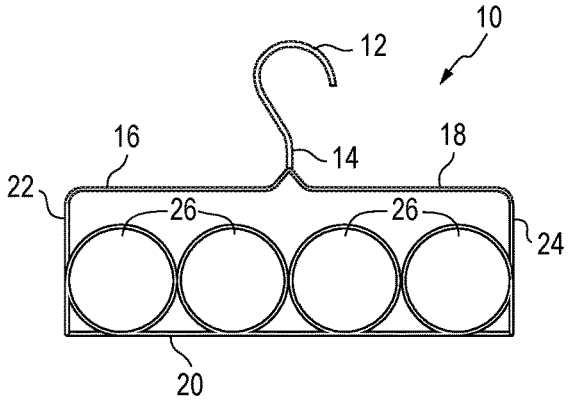
FIG. 18 is a front elevation view of a hanger for use in a storage system in accordance with another embodiment of the present invention.
Figure 19:
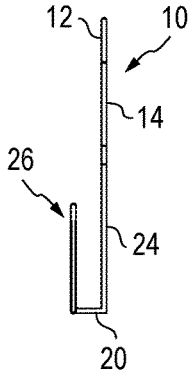
FIG. 19 is a side elevation view of the hanger of FIG. 18.
Figure 20:
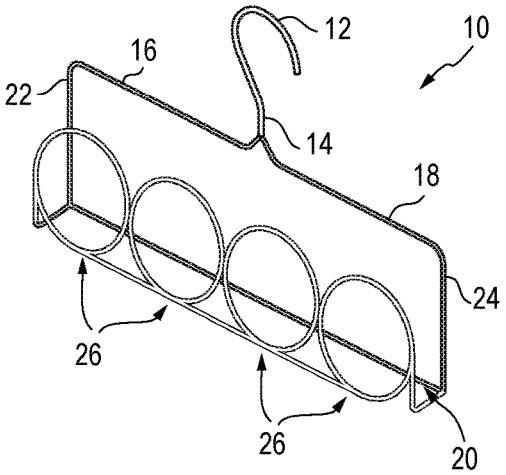
FIG. 20 is a perspective view of the hanger of FIG. 18.
Figure 21:
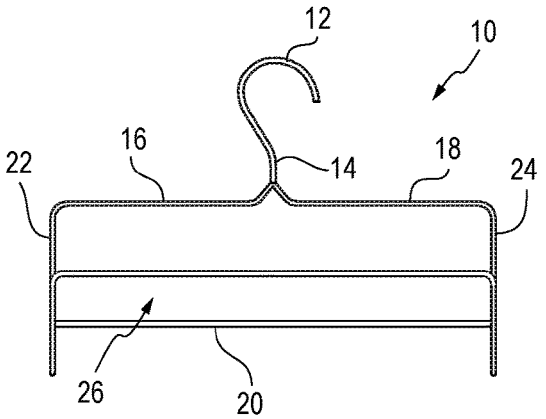
FIG. 21 is a front elevation view of a hanger for use in a storage system in accordance with another embodiment of the present invention.
Figure 22:
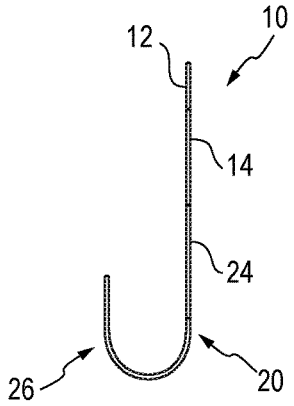
FIG. 22 is a side elevation view of the hanger of FIG. 21.
Figure 23:
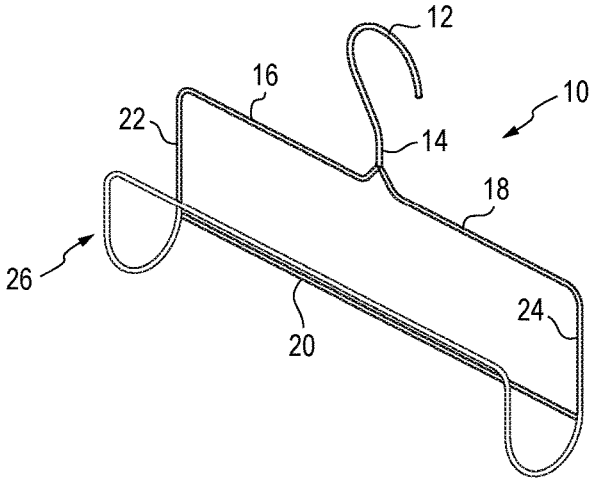
FIG. 23 is a perspective view of the hanger of FIG. 21.
Figure 24:
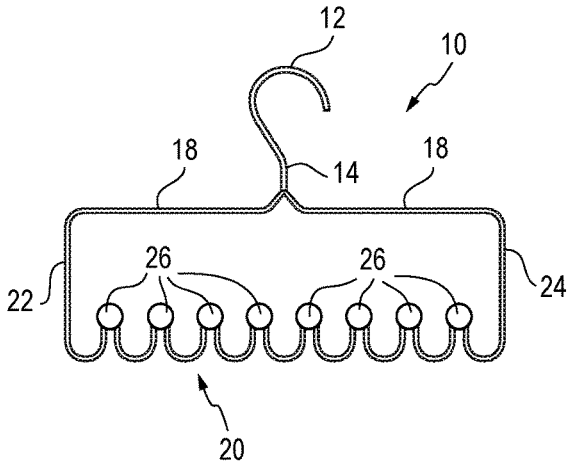
FIG. 24 is a front elevation view of a hanger for use in a storage system in accordance with another embodiment of the present invention.
Figure 25:
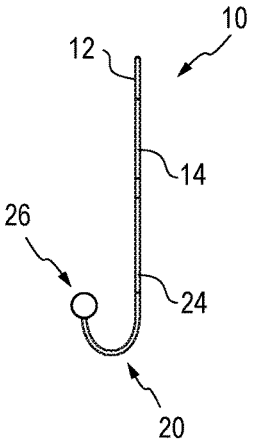
FIG. 25 is a side elevation view of the hanger of FIG. 24.
Figure 26:
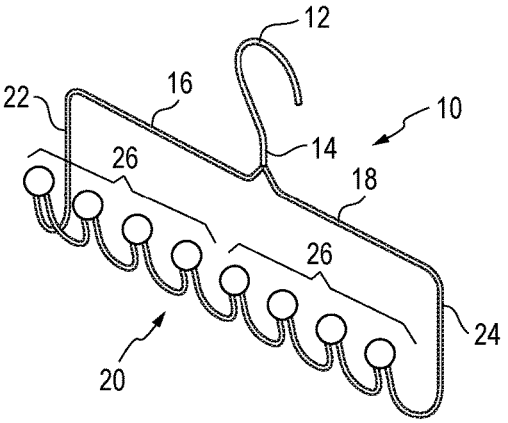
FIG. 26 is a perspective view of the hanger of FIG. 24.

According to an alternative embodiment of the present invention, hanger 10 can be configured without any accessory hooks 26. As illustrated in FIGS. 12-14, according to such an embodiment, hanger 10 can comprise a hook member 23, arms 16 and 18 and a crossbar member 20. Thus, in embodiments of the invention the accessory holders are optional.

As best shown in FIGS. 2-4, according to one exemplary embodiment, accessory hooks 26 can be formed into crossbar 20 by forming a plurality of alternating straight portions 28 and bent portions 30 in a wavelike manner across the length of crossbar 20. As best shown in FIG. 3, straight portions 28 can extend diagonally upward from the original plane of crossbar 20 and can be joined together by a bent portion 30 in order to form one accessory hook 26. This pattern can be repeated across the length of crossbar 20 in order to form additional accessory hooks 26. As best shown in FIG. 4, straight portions 28 can be angled away from the remainder of hanger 10 in order to space accessory hooks 26 from first and second arms 16 and 18. As also shown in FIG. 4, crossbar 20 can additionally include an outwardly extending end portion 32 extending from each outer end 22 and 24 of first and second arms 16 and 18 in order to space accessory hooks 26 outward and away from the original plane of crossbar 20.

FIGS. 15-26 illustrate hanger 10 with accessory hook(s) 26 according to several alternative embodiments of the present invention. As illustrated in the several figures, accessory hook or hooks 26 can be configured in any number of different sizes and shapes.

Figure 27:
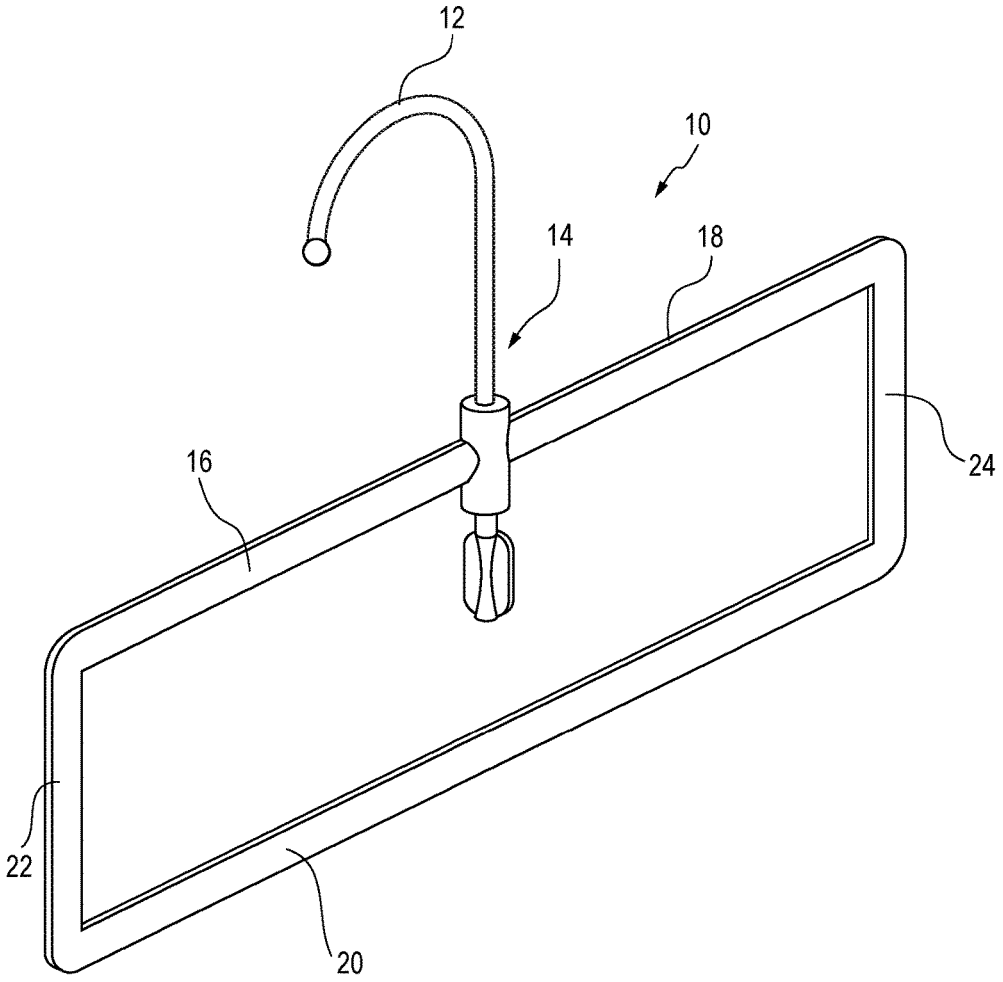
FIG. 27 is a perspective view of a hanger for use in a storage system in accordance with another embodiment of the present invention.
Figure 28A:
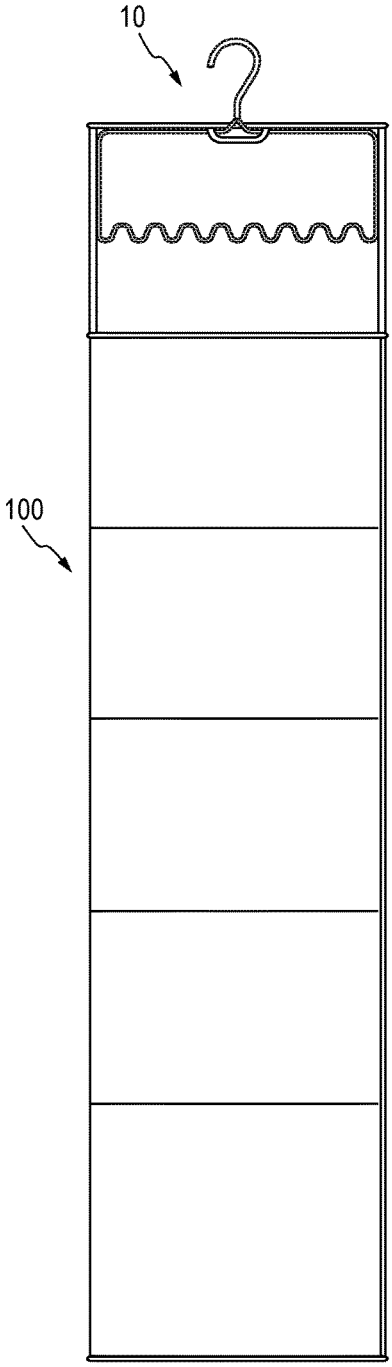
FIGS. 28A through 28D are schematic elevations views of a storage system in accordance with one embodiment of the present invention.
Figure 28B:
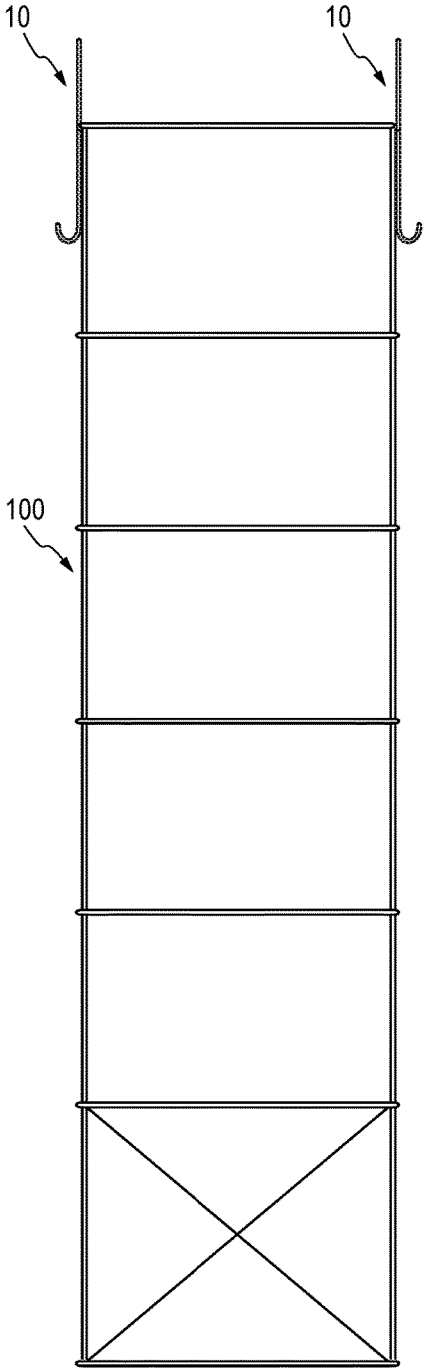
Figure 28C:
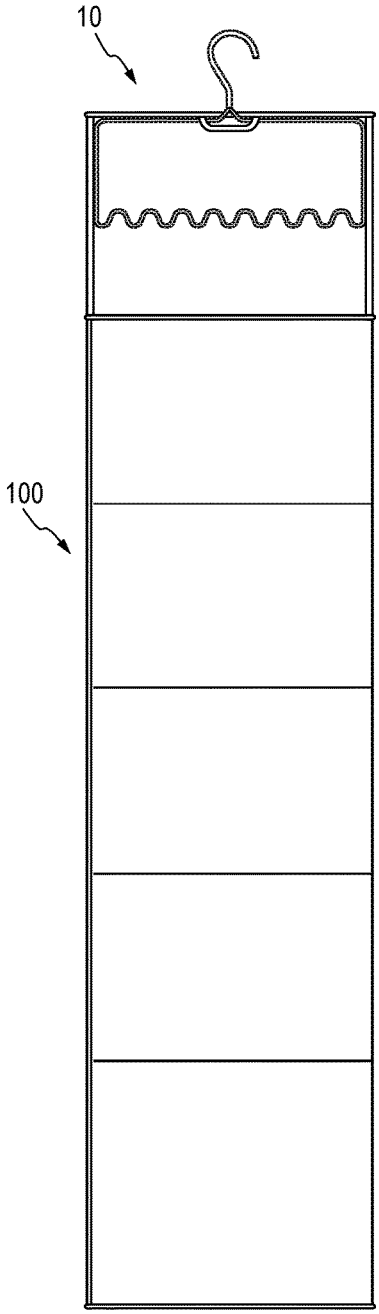
Figure 28D:
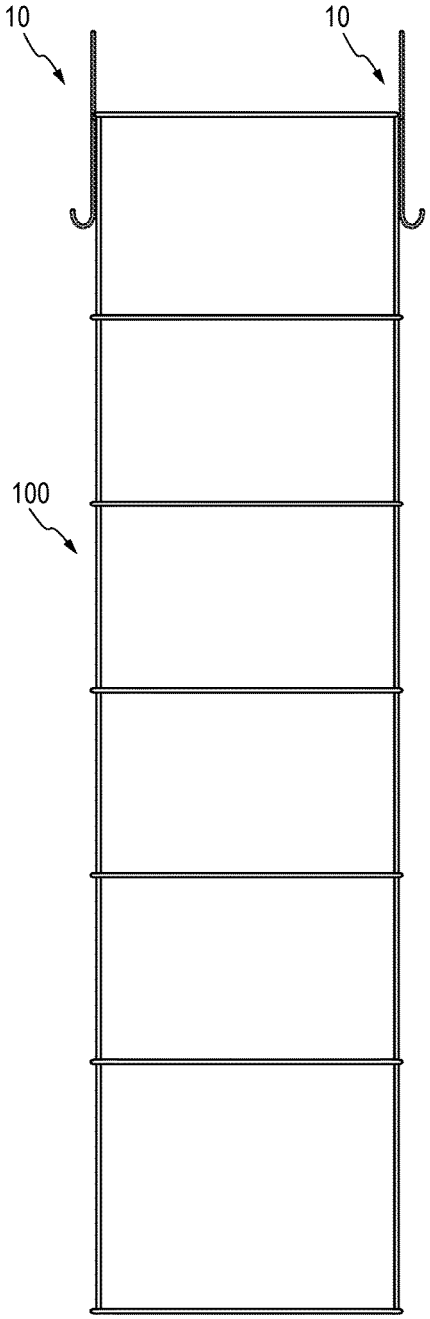

FIG. 27 illustrates another embodiment of hanger 10 having a swivel component located at lower end 14 of hook member 12. The swivel component can be configured to allow hook member 12 to rotate relative to arms 16 and 18 to enable hook member 12 to be repositioned without moving arms 16 and 18 and the remainder of hanger 10.

Figure 5:
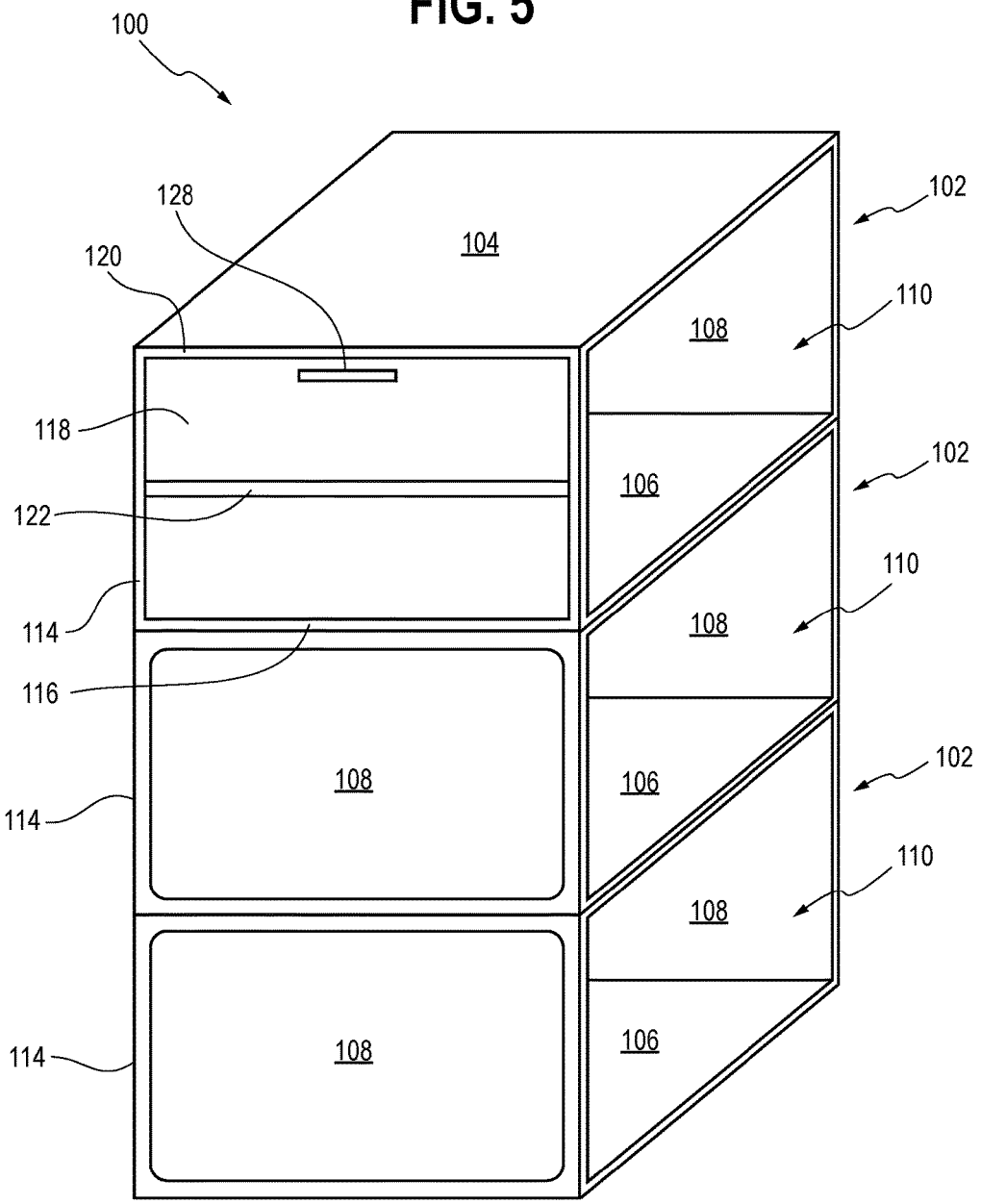
FIG. 5 is a perspective view of a storage unit for use in a storage system in accordance with one embodiment of the present invention.
Figure 6:
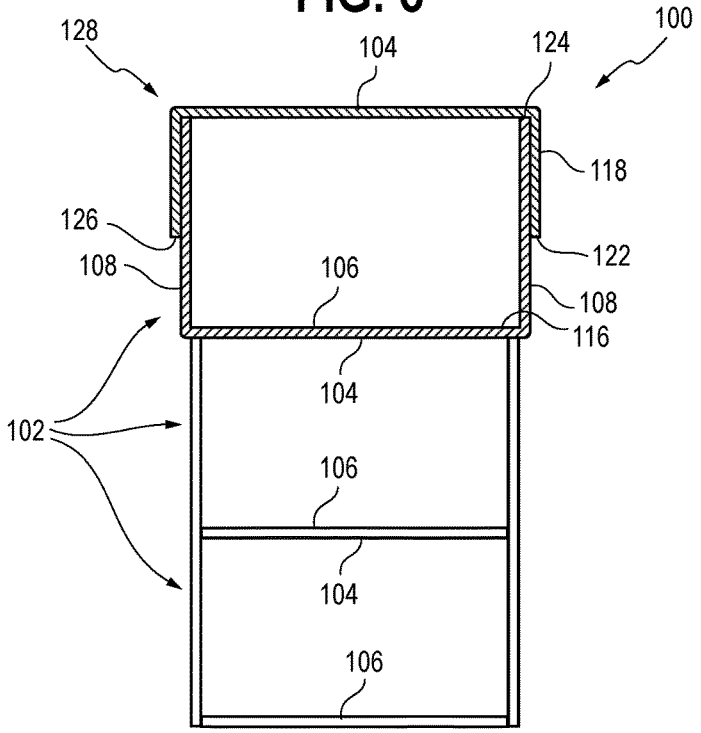
FIG. 6 is a front elevation view of the storage unit of FIG. 5.
Figure 7:
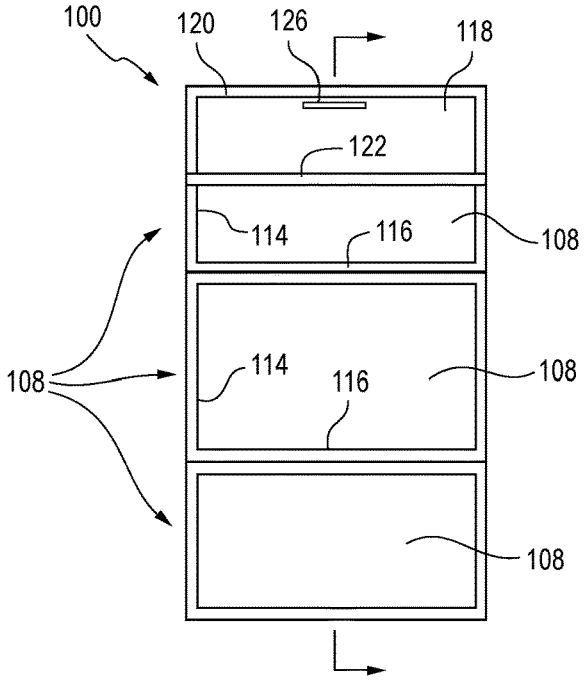
FIG. 7 is a side elevation view of the storage unit of FIG. 5.

Turning to FIGS. 5-7, storage unit can comprise one or more storage compartments 102 orientated in a vertical configuration as shown or, alternatively, in a horizontal configuration (not shown). According to one exemplary embodiment, each storage compartment 102 can include atop panel 104, a bottom panel 106 and at least two sidewall panels 108. As best shown in FIG. 5, sidewall panels 108 can provide for a first opening 110 for allowing access to the interior of storage compartment 102, and a second opening opposing first opening 110 and also formed by sidewall panels 108 (along with top and bottom panels 104 and 106, respectively). In certain alternative embodiments (not shown), storage compartment 102 can include a rear panel between sidewall panels 108 and opposing opening 110 in place of second opening. It is also recognized that several other configurations for storage compartments 102 can be utilized in other alternative embodiments of the present invention. In some embodiments, the top panel and bottom panel can be one piece for the interior storage compartments. Here 104 and 106 can be read as top and bottom surfaces of one panel.

As shown in FIGS. 5-7, each sidewall panel 108 of the top storage compartment 102 in storage unit 100 can include a sidewall panel perimeter 114 defining the perimeter edges of the sidewall panel 108, including a sidewall panel lower edge 116.

As also shown in FIGS. 5-7, each sidewall panel 108 of the top storage compartment 102 can further include an overlapping panel/pocket panel 118 provided on the sidewall panel 108 in an overlapping fashion. Overlapping panel 118 can include an overlapping panel perimeter 120 that defines the perimeter edges of overlapping panel 118, including an overlapping panel lower edge 122. Overlapping panel/pocket panel perimeter 120 can be at least partially secured to sidewall panel 108 in order to form a pocket 124 between the sidewall panel 108 and overlapping panel 118. According to one embodiment, as shown in FIGS. 5-7, overlapping panel perimeter 120 can be secured to sidewall panel perimeter 114; however, in alternative embodiments, overlapping panel perimeter 120 can be secured to other portions of sidewall panel 108. In other embodiments, the perimeter is simply stitching that serves as reinforcement.

Pocket 124 can be configured to receive and hold hanger 10 between sidewall panel 108 and overlapping panel 118. In order to allow hanger 10 to be inserted into pocket 124, a lower opening 126 can be provided between bottom edge 122 of overlapping panel 118 and sidewall panel 108. Lower opening 126 can be formed by securing the vertical edges of overlapping panel perimeter 120 to sidewall 108 and leaving bottom edge 122 of overlapping panel unsecured. In alternative embodiments (not shown), lower opening can also be formed through overlapping panel 118 at a location within perimeter 120 (i.e., above bottom edge 122) and bottom edge 122 can be secured to sidewall 108. Lower opening 126 can be sized and configured to allow hanger 10 to be fully inserted therethrough.

As best shown in FIGS. 5 and 7, storage unit 100 can additionally include a hook opening 128 provided near the upper edge of overlapping panel 118. Hook opening 128 can be configured to allow hook member 12 of hanger 10 to exit pocket 124 while first and second arms 16 and 18 remain contained within pocket 124. According to one embodiment, hook opening 128 is formed by making a cut, slit or other aperture through overlapping panel 118. According to another embodiment, hook opening 128 is formed by leaving a central portion of the upper edge of overlapping panel perimeter 120 unsecured while the remaining portions of the upper edge are secured to sidewall panel 108.

Figure 8:
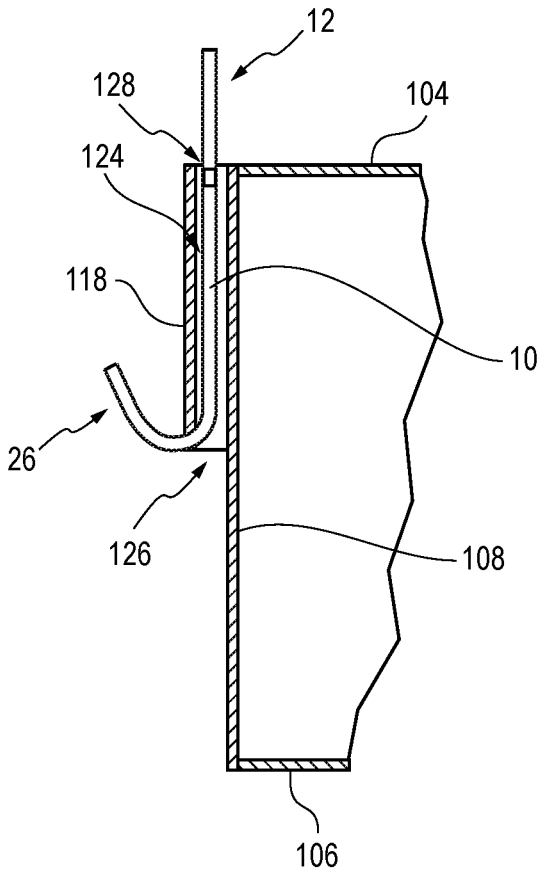
FIG. 8 is a schematic section view of the storage system of FIG. 1 illustrating a pocket used within the storage system in accordance with one embodiment of the present invention.

Turning now to FIGS. 8-11, the configuration of storage system 1, and particularly pocket 124 of storage unit 100 relative to hanger 10, will be described in greater detail. FIG. 8 shows a section view of an embodiment of the present invention illustrating hanger 10 located within pocket 124 of storage unit 100. As shown, hanger 10 can be slide through lower opening 126 and into pocket 124. Pocket 124 can be sized to allow first and second arms 16 and 18, along with downward-turned outer ends 22 and 24, to be fully positioned within pocket 124 while hook member 12 exits through hook opening 128 located along the top of pocket 124. According to one embodiment, overlapping panel 118 has a height approximately equal to the height of hanger 10 absent hook member 12. Sidewall panel 108 of top storage compartment 102 can have a height approximately equal to or greater than the height of overlapping panel/pocket panel 118. According to the embodiment shown in the figures, sidewall panel 108 has a height greater than overlapping panel 108 and bottom edge 122 of overlapping panel perimeter 120 can be positioned above bottom edge 116 of sidewall panel perimeter 114. As further shown in FIG. 8, overlapping panel 118 can be secured to sidewall panel 108 of top storage compartment 102 so that hook member 12 is located above top panel 104 of top storage compartment 102 when hanger 10 is located within pocket 124.

As best shown in FIGS. 8, 10A, 10B and 11, accessory hooks 26 of hanger 10 can be positioned outside of pocket 124 when hanger 10 is inserted in pocket 124. As best illustrated in FIG. 8, outward-extending portion 32 of crossbar 20 can extend outward from outer ends 22 and 24 of first and second arms 16 and 18, respectively, in order to allow the remainder of crossbar 20 and accessory hooks 26 to be positioned outside pocket 24 and adjacent to the exterior of overlapping panel 118 and bottom edge 122. As best shown in FIG. 10B, accessory hooks 26 can be used to hold various objects (e.g., hats, belts, etc.) on the outer portion of storage unit 100.

Figure 9:
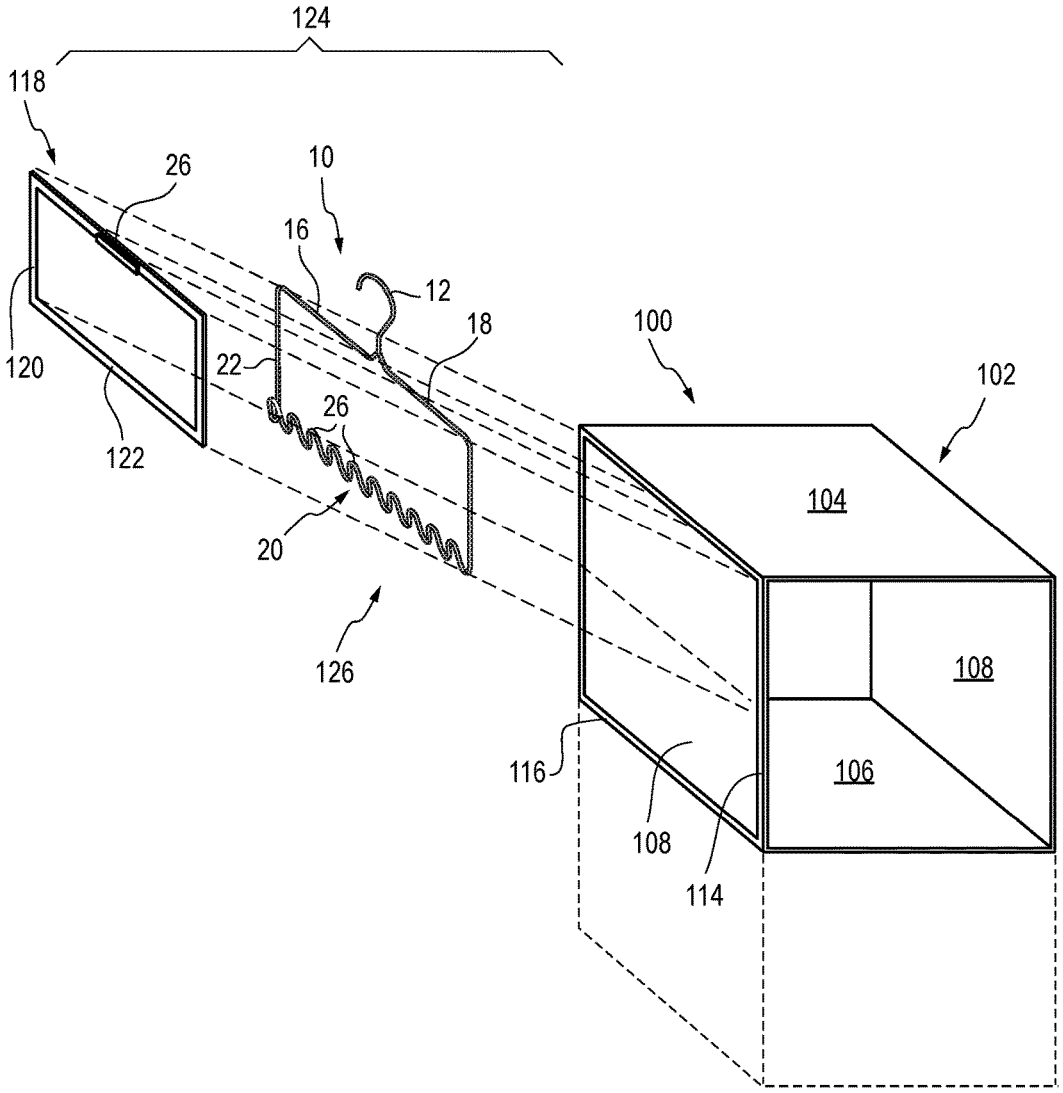
FIG. 9 is a schematic exploded perspective view of a storage system illustrating the relationship of a hanger and a storage unit used in the storage system in accordance with one embodiment of the present invention.

FIG. 9 shows an exploded schematic view of storage system 1 illustrating hanger 10 positioned between overlapping panel 118 and sidewall panel 108 and within pocket 124. As shown, overlapping panel 118 and sidewall panel 108 (and as a result pocket 124) can have a length at least as large as the length of hanger 10 so that hanger 10 can be inserted into pocket 124. As also shown, overlapping panel 118 and sidewall panel 108 can have a height at least as tall as hanger 10 (not including hook member 12) so that first and second arms 116 and 118 of hanger 10 can be fully inserted and positioned within pocket 124. According to one embodiment of the present invention, overlapping panel 118 has a height less than sidewall panel 108 and approximately equal to hanger 10 (absent hook member 12) as shown in FIG. 9.

Figure 10A:
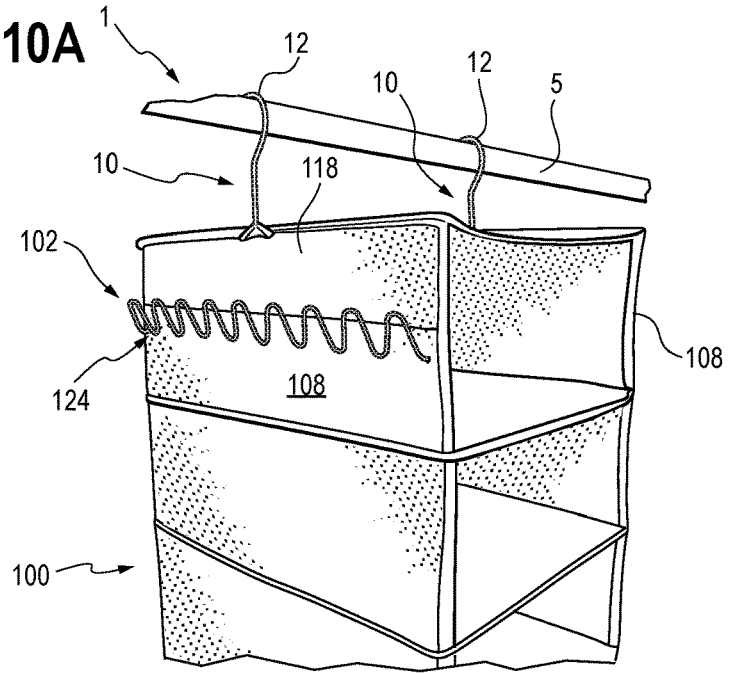
FIGS. 10A and 10B are photographic perspective views of a storage system illustrating a hanger component of the storage system supporting a storage unit and suspending the storage system from a hanging rod in accordance with one embodiment of the present invention.
Figure 10B:
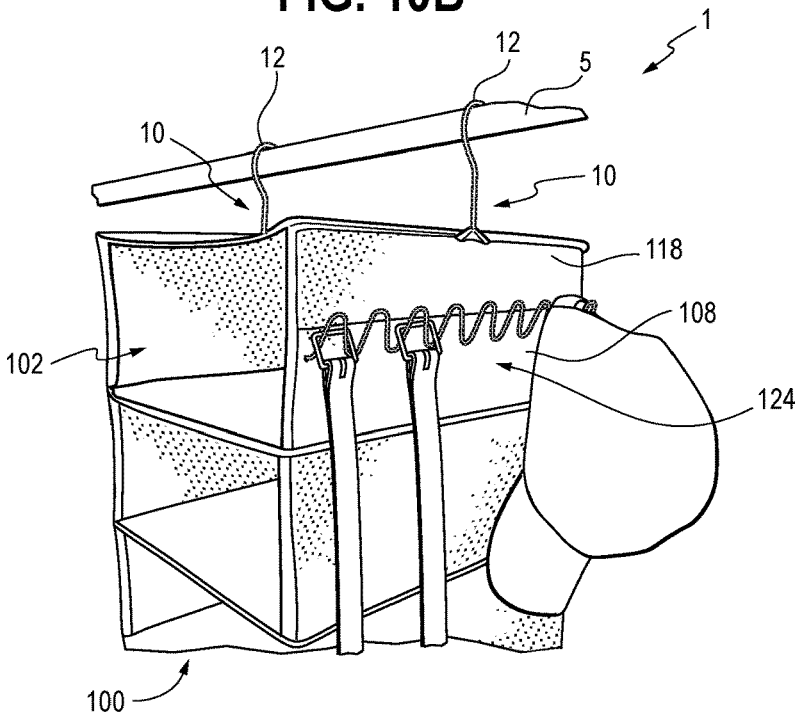

FIGS. 10A and 10B show storage system 1 suspended from a hanging rod 5 by hangers 10 inserted into pockets 124 located between overlapping panels 118 and sidewall panels 108 of top storage compartment 102 according to one embodiment of the present invention. As shown, when hangers 10 are inserted into pockets 124 and suspended hook members 12 are placed over hanging rod 5, pocket 124 is configured to hangers 10 and thus storage unit 100. Hangers 10 can remain in pocket 124 when storage system 1 is suspended from hanging rod 5 as a partial result of upper hook opening 128 of pocket 124 allowing only hook member 12 to extend beyond pocket 124. First and second arms 16 and 18 of hanger 10 are also prevented from moving past the upper boundary of pocket 124 because upper hook opening 128 has a length less than the total length of hanger 10 and the connection between overlapping panel 118 and sidewall panel 108 allow the remaining upper boundary of pocket 124 to support and retain hanger arms 16 and 18.

Figure 11A:
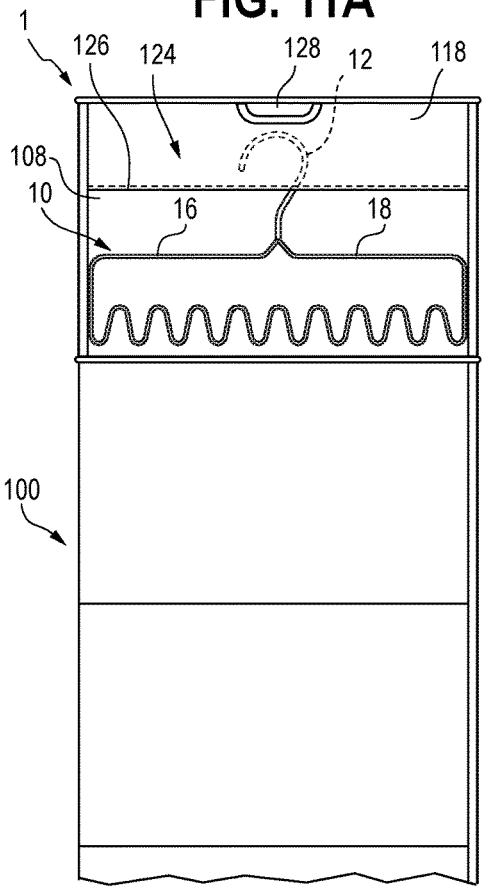
FIGS. 11A and 11B are a schematic side elevation views of a storage system with a storage unit and a hanger illustrating the hanger being inserted into a pocket provided on the storage unit in accordance with one embodiment of the present invention.
Figure 11B:
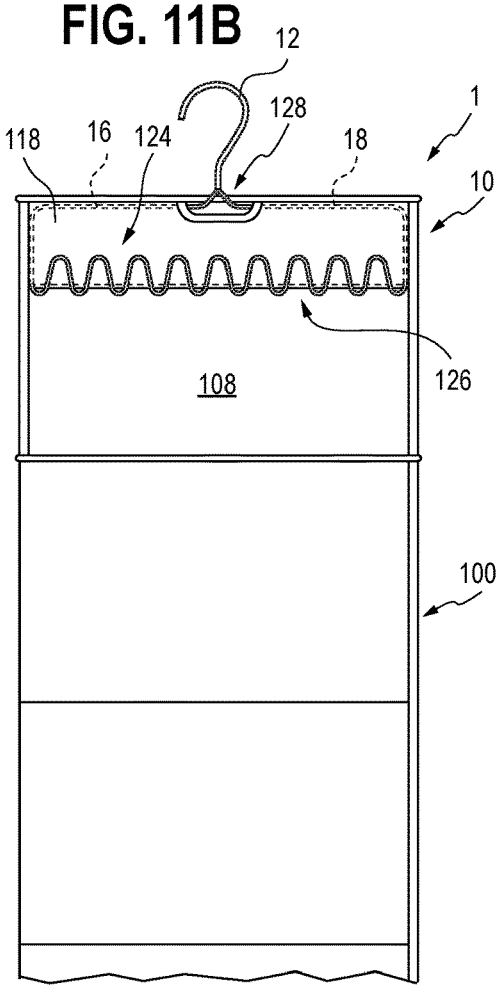

FIG. 11 illustrates hanger 10 being inserted into pocket 124 of storage unit 100 according to an exemplary embodiment of the present invention. As illustrated, hanger 10 can be positioned below pocket 124 and then inserted through lower opening 126. Hook member 12 of hanger 10 can then be inserted through upper opening 128 so that the entirety of hanger 10 is located within pocket 124 with the exception of hook member 12 and accessory hooks 26.

According one exemplary embodiment of the present invention, storage system 1 can be configured to allow hangers 10 to be removable from pockets 124. In such an embodiment, lower opening 126 between overlapping panel 118 and sidewall panel 108 remains unsecured so that hanger 10 can be inserted into pockets 124 and then also removed from pockets 124 through lower opening 126. In alternative embodiments, lower opening 126 can be at least partially secured around crossbar 20 after hanger 10 has been inserted into pocket 124 to keep hanger arms 16 and 18 positioned within pocket 124 even when not being suspended from banging rod 5. In yet another alternative embodiment, lower opening 126 can be at least partially selectively securable (such as by means of hook and loop fasteners or other suitable selective enclosure means) so that pocket 10 can selectively retain hanger 10 when desired by a user.

Hanger 10 and its components can be constructed from any number of materials that are suitable for allowing hanger 10 to hang from a hanging rod 5 or similar object. Such materials can include but are not limited to metal, plastic, rubber, fabric, polymer-based material, silicon-based material, or any combination thereof. Storage unit 10 can similarly be constructed from any number of materials commonly used or suitable for use in a storage structure. According to one embodiment, storage unit 10 is constructed from a fabric-based material and sewn connections can be utilized between different panels, perimeters, and edges. For example, overlapping panel perimeter 120 can be at least partially sewn to a portion of sidewall panel perimeter 114. It is also recognized that different materials and connections can be utilized in alternative embodiments of the present invention.

FIGS. 28A-28D are schematic elevations views of a storage system in accordance with one embodiment of the present invention. These figures show front, back, and side views of an embodiment of the present invention. In this embodiment, the storage system includes six storage compartments.

Figure 29:
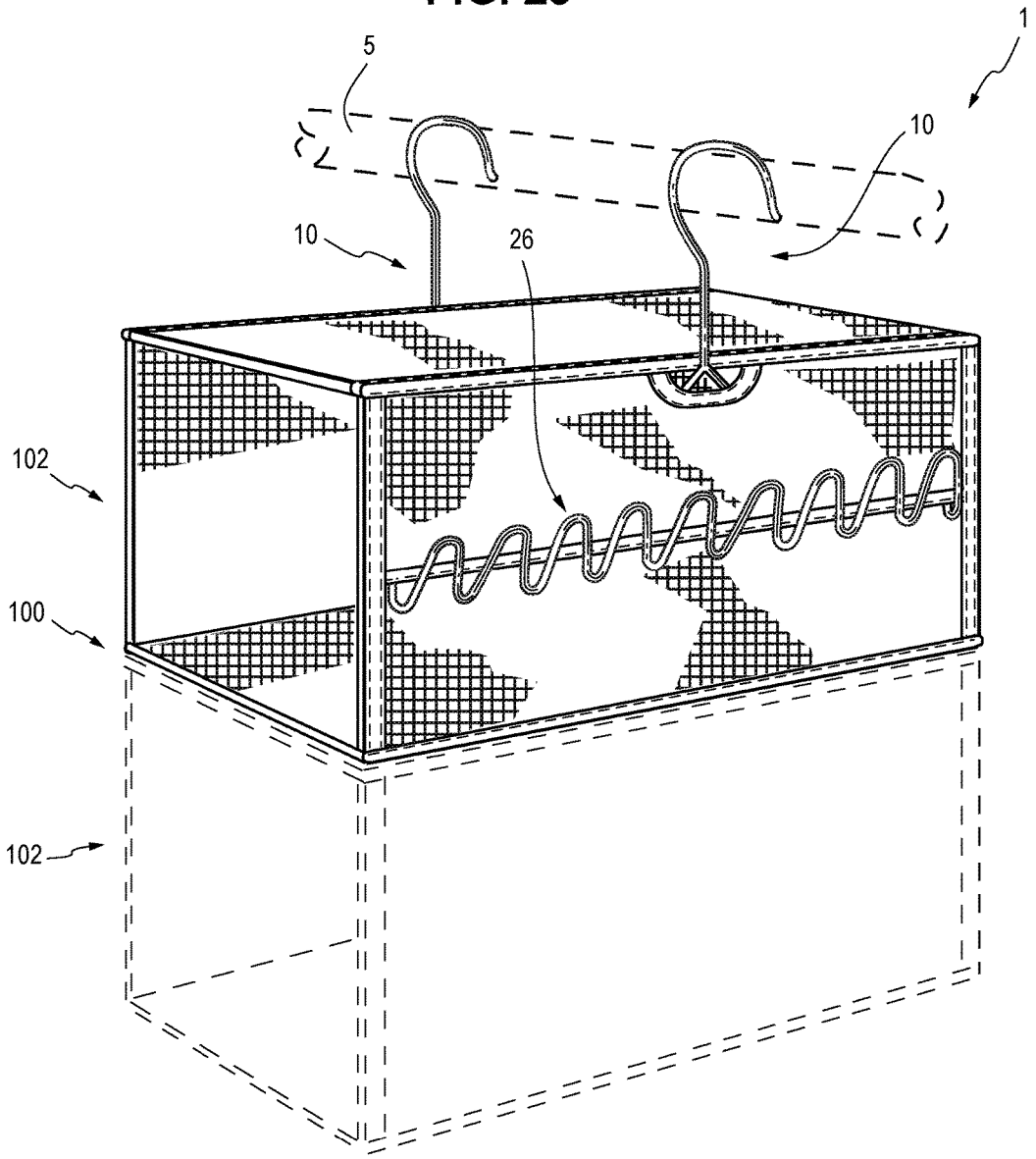
FIG. 29 is a schematic perspective view of a storage system in accordance with one embodiment of the present invention.

FIG. 29 is a schematic perspective view of a storage system in accordance with one embodiment of the present invention. It shows the versatility of the present invention in connection with the number of storage compartments. More detail is shown with respect to the top storage compartment.

Figure 30:
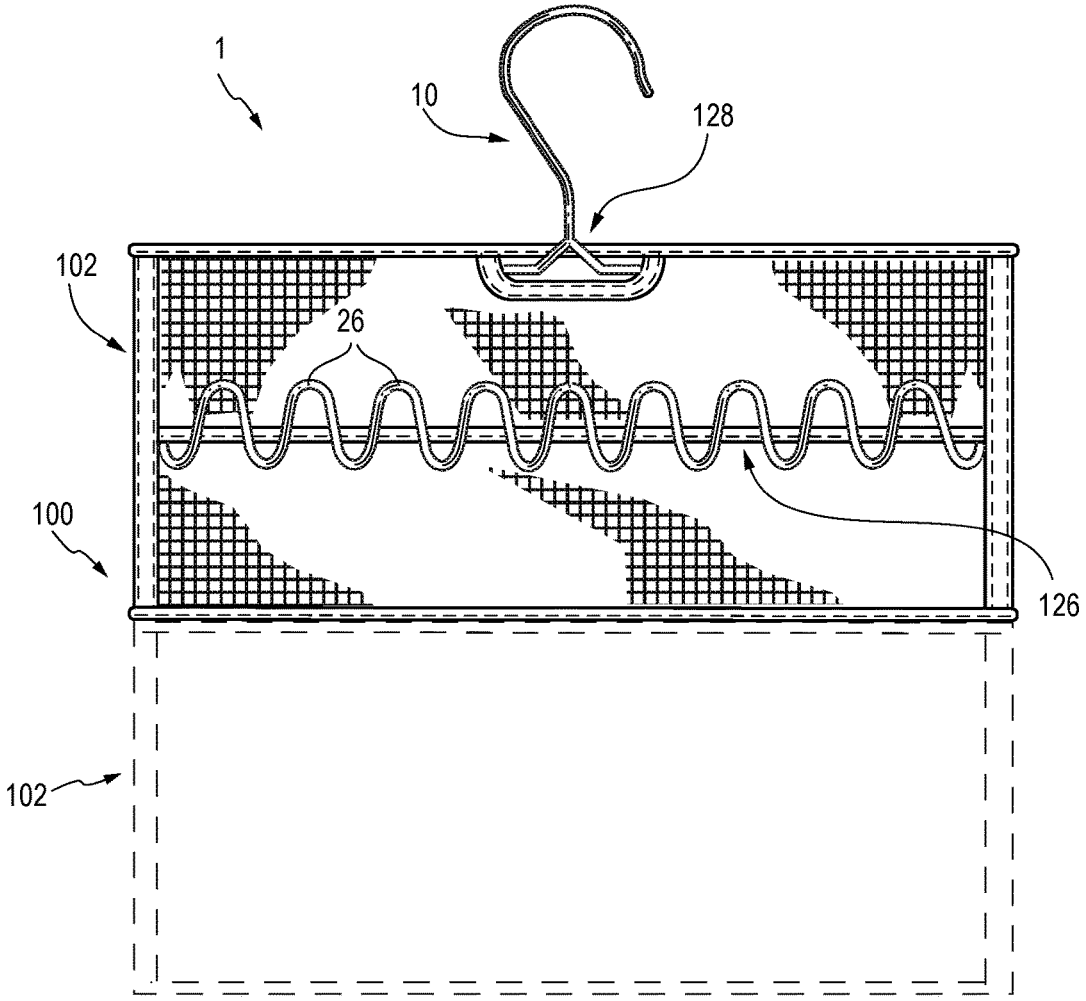
FIG. 30 is a schematic side elevation view of the storage system of FIG. 29.

FIG. 30 is a schematic side elevation view of the storage system of FIG. 29.

Figure 31:
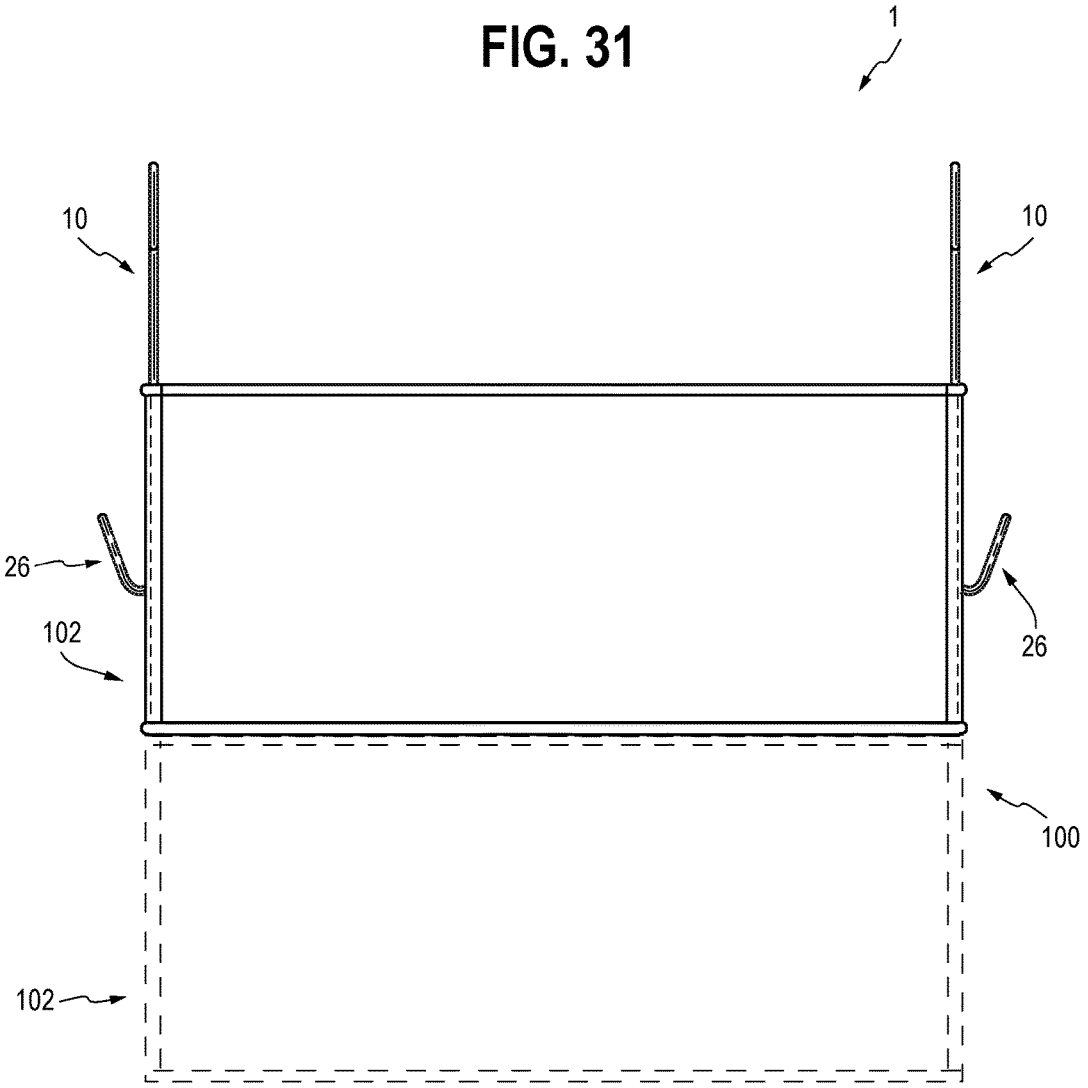
FIG. 31 is a schematic front elevation view of the storage system of FIG. 29.

FIG. 31 is a schematic front elevation view of the storage system of FIG. 29.

Figure 32:
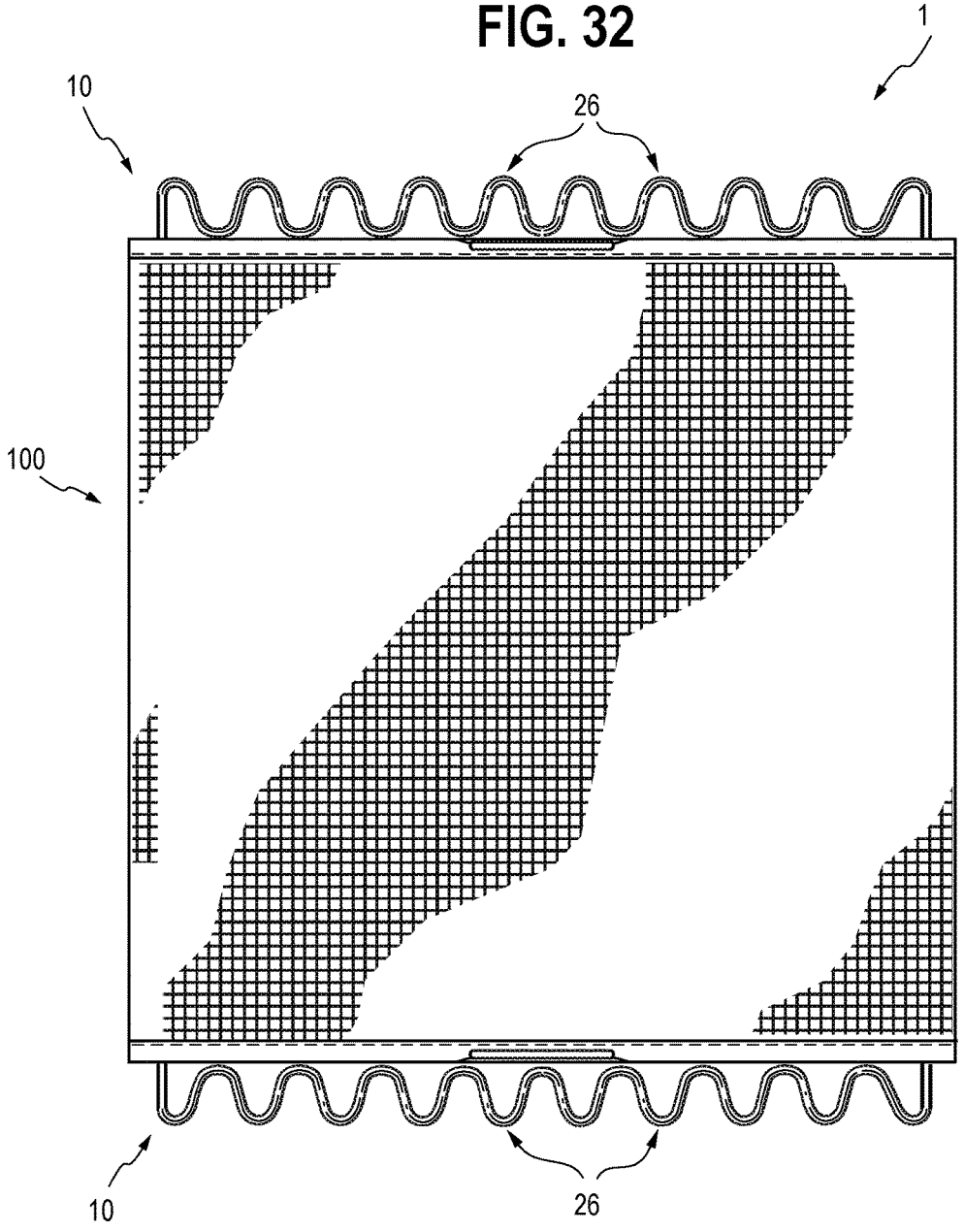
FIG. 32 is a schematic top plan view of the storage system of FIG. 29.

FIG. 32 is a schematic top plan view of the storage system of FIG. 29.

Figure 33:
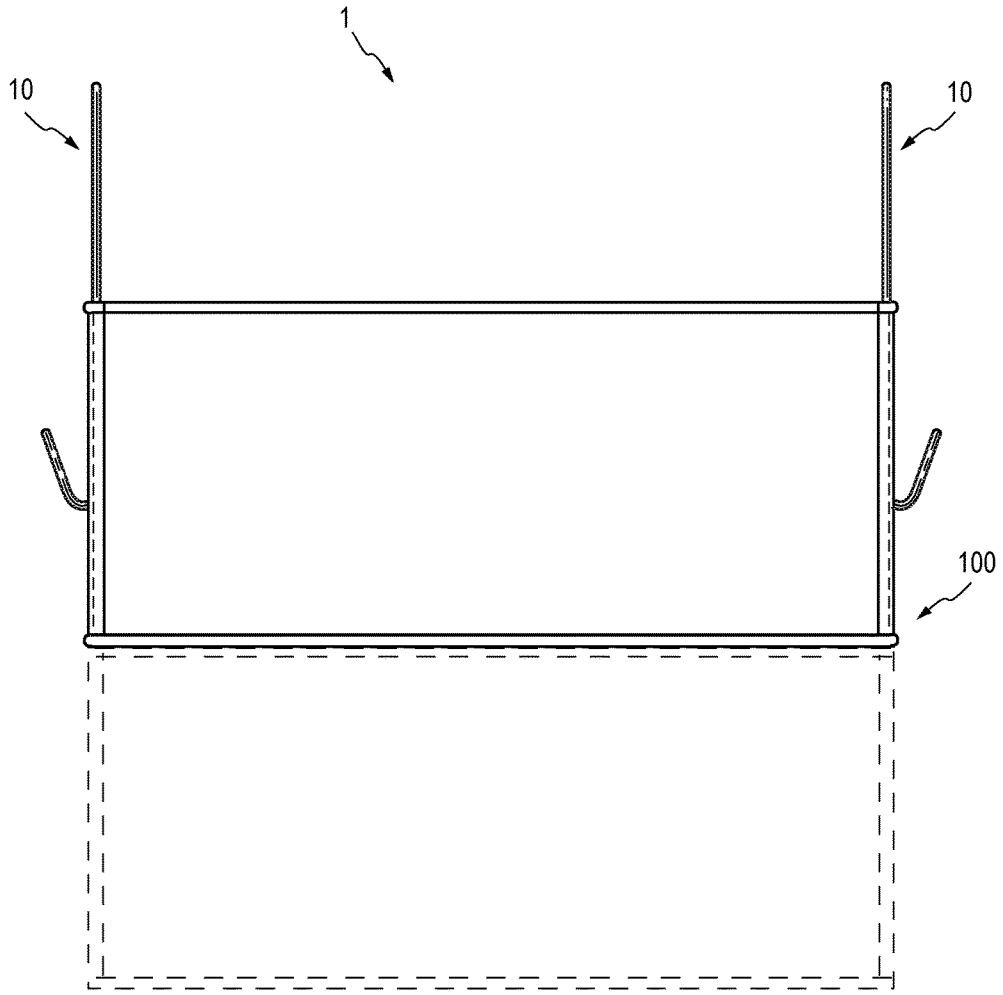
FIG. 33 is a schematic rear elevation view of the storage system of FIG. 29.

FIG. 33 is a schematic rear elevation view of the storage system of FIG. 29.

Figure 34:
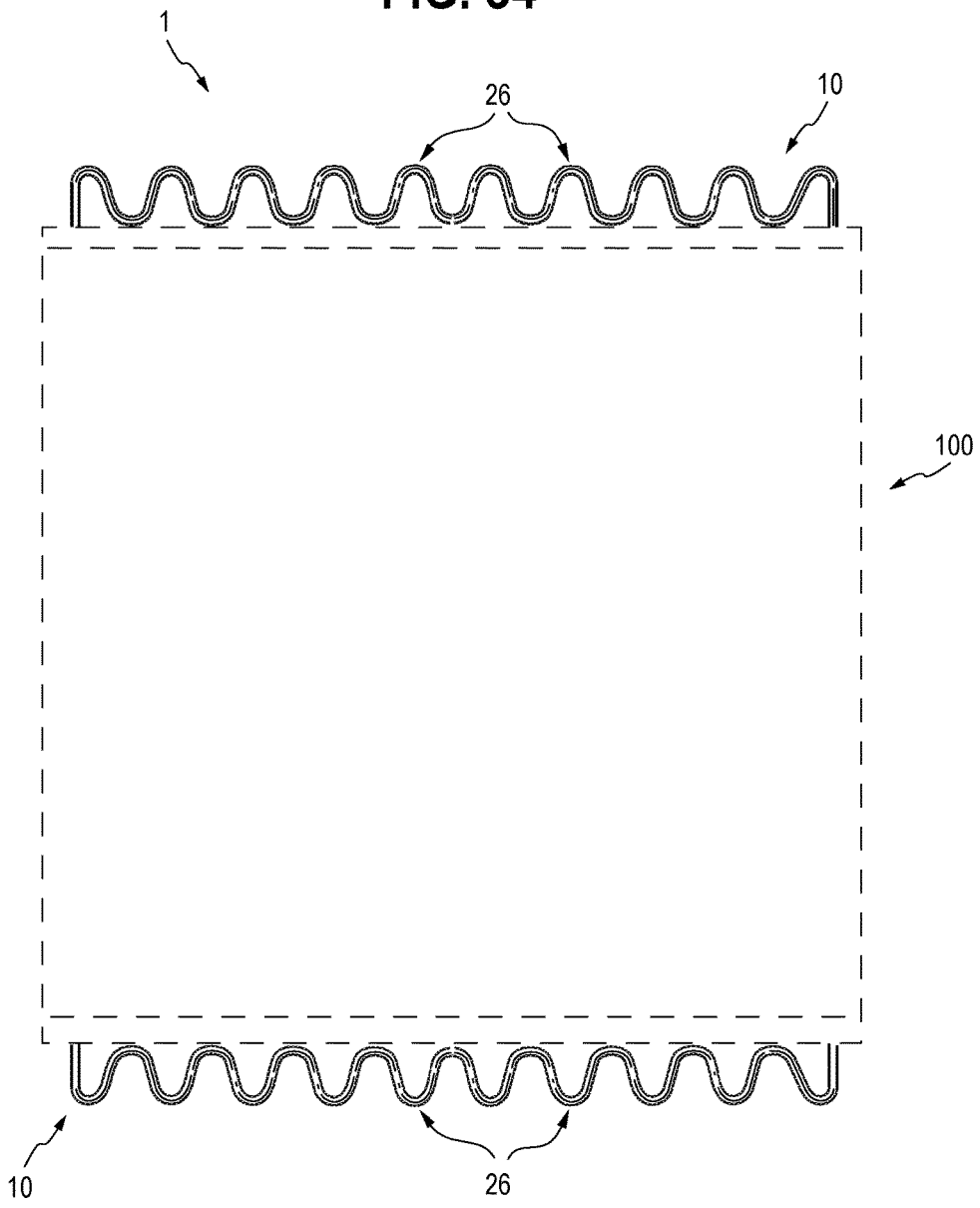
FIG. 34 is a schematic bottom plan view of the storage system of FIG. 29.

FIG. 34 is a schematic bottom plan view of the storage system of FIG. 29.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A storage system comprising:

a hanger comprising:

a hook portion;

a pair of arms extending away from a lower end of said hook portion;

an outer end on each of said arms; and a crossbar extending between said outer ends, the crossbar comprising one or more accessory hooks that extend away from said crossbar at an angle relative to said arms, said one or more accessory hooks being formed by a plurality of alternating straight portions and bent portions arranged in a wavelike pattern; and a storage unit comprising:

a first compartment;

a first sidewall panel defining one side of said first compartment;

an overlapping panel provided over at least a portion of said first sidewall panel;

a pocket formed between said first sidewall panel and said overlapping panel;

a lower pocket opening positioned along a lower end of said pocket, said lower pocket opening being sized to allow said hanger to be inserted into said pocket; and a hook pocket opening positioned along a top end of said pocket, said hook pocket opening being sized to allow said hook portion of said hanger to be inserted said hook pocket opening and above said storage unit;

wherein said accessory hooks are located outside said pocket when said hanger is positioned within said pocket.

2. The storage system of claim 1, wherein said hanger is removable from said pocket.

3. The storage system of claim 1, wherein said overlapping panel includes an overlapping panel perimeter, wherein at least a portion of said overlapping panel perimeter is secured to said first sidewall panel.

4. The storage system of claim 3, wherein said first sidewall panel has first sidewall panel perimeter, wherein at least a portion of said overlapping panel perimeter is secured to said first sidewall panel perimeter.

5. The storage system of claim 3, wherein said first sidewall panel has a first sidewall panel perimeter, wherein said overlapping panel perimeter includes a bottom edge that is unsecured to said first sidewall panel and located above a bottom edge of said first sidewall panel perimeter.

6. The storage system of claim 1, wherein said overlapping panel has an overlapping panel height and said first sidewall panel has a sidewall panel height, wherein said overlapping panel height is less than said sidewall panel height.

7. The storage system of claim 1, wherein said accessory hooks extend away from said first sidewall panel and said overlapping panel when said hanger is located within said pocket.

8. A storage unit comprising:

a hanger having a plurality of accessory hooks provided on a lower crossbar, said plurality of accessory hooks being formed by alternating straight portions and bent portions arranged in a wavelike pattern;

a storage compartment; and a pocket provided on a sidewall of said storage compartment;

wherein said hanger is removably insertable into said pocket and configured to support said storage compartment when said hanger is suspended from a hanging rod, and wherein said plurality of accessory hooks are located outside of said pocket when said hanger is inserted into said pocket.

9. The storage unit of claim 8, wherein said pocket includes a lower opening and an upper hook member opening, wherein said lower opening is configured for receiving said hanger and said upper hook member opening is configured for receiving a hook member of said hanger.

10. The storage unit of claim 8, further comprising an overlapping panel connected to said sidewall of said storage compartment, wherein said pocket is located between said overlapping panel and said sidewall.

11. The storage unit of claim 10, wherein said overlapping panel is located on an exterior side of said sidewall.

12. The storage unit of claim 8, wherein said lower crossbar includes a plurality of alternating straight portions and bent portions that form said plurality of accessory hooks.

13. A storage system configured for being suspended from a hanging rod, said storage system comprising:

a storage unit having one or more storage compartments defined by a storage unit sidewall;

a pocket provided on an exterior side of said storage unit; and a hanger comprising:

a hook member having a lower end;

a pair of arms extending in opposing directions from said lower end of said hook member, wherein each arm includes a downwardly turned outer end;

a crossbar extending between said outer ends of said arms; and a plurality of alternating straight portions and bent portions arranged in a wavelike pattern formed into said crossbar to form a plurality of accessory hooks;

wherein said hanger is configured for being inserted into said pocket and supporting said storage unit when said storage system is suspended from said hanging rod, and wherein said plurality of accessory hooks are located outside of said pocket when said hanger is inserted into said pocket.

* * * * *